US005406815A

United States Patent [19]

Sedley

[11] Patent Number: 5,406,815

[45] Date of Patent: Apr. 18, 1995

[54] MAGNETIC KEY OPERATED CODE-CHANGE LOCK

[76] Inventor: Bruce S. Sedley, Flat C, 5th Floor, Block 30, Stage 2, Broadway Street, Mei Foo Sun Cheun, Hong Kong

[21] Appl. No.: 30,254

[22] PCT Filed: Sep. 30, 1991

[86] PCT No.: PCT/GB91/01683

§ 371 Date: Mar. 25, 1993

§ 102(e) Date: Mar. 25, 1993

[87] PCT Pub. No.: WO92/06264

PCT Pub. Date: Apr. 16, 1992

[30] Foreign Application Priority Data

Sep. 28, 1990 [GB] United Kingdom ..... 9021111

[51] Int. Cl.[6] ..... E05B 47/00

[52] U.S. Cl. ..... 70/276; 70/413

[58] Field of Search ..... 70/276, 413, 382–385

[56] References Cited

U.S. PATENT DOCUMENTS

| | | | |
|---|---|---|---|
| 3,566,637 | 3/1971 | Hallmann | 70/276 |
| 3,955,388 | 5/1976 | Stackhouse | 70/413 X |
| 3,995,460 | 12/1976 | Sedley | 70/413 X |
| 4,312,198 | 1/1982 | Sedley | 70/276 |
| 4,576,025 | 3/1986 | Kassza et al. | 70/276 |
| 4,932,228 | 6/1990 | Eisermann | 70/276 |
| 5,012,659 | 5/1991 | Eisermann | 70/276 |
| 5,072,604 | 12/1991 | Eisermann | 70/276 |
| 5,074,135 | 12/1991 | Eisermann | 70/276 |
| 5,271,253 | 12/1993 | Cassada et al. | 70/276 |
| 5,291,766 | 3/1994 | Eisermann | 70/276 |

FOREIGN PATENT DOCUMENTS

| | | | |
|---|---|---|---|
| 0024242 | 2/1981 | European Pat. Off. | E05B 47/00 |
| 0241323 | 10/1987 | European Pat. Off. | E05B 47/00 |
| 0304760 | 3/1989 | European Pat. Off. | E05B 47/00 |
| 2138991 | 2/1973 | Germany | 70/413 |
| 223277 | 9/1989 | Japan | 70/413 |
| WO9009503 | 8/1990 | WIPO | E05B 47/00 |

*Primary Examiner*—Peter M. Cuomo
*Assistant Examiner*—Suzanne L. Dino
*Attorney, Agent, or Firm*—Eckert Seamans Cherin & Mellott

[57] ABSTRACT

A magnetic key operated lock has code changing magnet pins 108*a*, 110*a*, 112*a* and 114 *a* mounted in rotatable carriers 104 and 106 in a slide member 6. Spurious rotation of the carriers is prevented by a spring biassed bar 400 which is only released by keys, coded as code changing keys, when they are fully inserted and pressed against an end 403 of the bar 400 and by carriers 104 and 106 held against rotational movement by one or more of the above pins entering blind bores; the pins also acted upon by such keys in the slide member 6 when they are fully inserted.

10 Claims, 4 Drawing Sheets

MAGNETIC KEY OPERATED CODE-CHANGE LOCK

The present invention relates to locks which are operated by magnetic keys.

Such locks are already known and described for example in European applications EP 0241323 and EP 002422 and PCT Application PCT/GB90/00246.

Briefly, in such locks a slide member carries a plurality of tumblers in the form of small cylindrical magnets (magnet pins) which are slidably received in bores in the slide member so as to slide transversely of the direction of movement of the member. In the locked position, the pins are attracted towards a magnetic plate so that they extend part way out of the bores and through apertures in a non-magnetic lock plate which is fixed in position and located between the slide member and magnetic plate. Hence the pins lock the slide member in position relative to the non-magnetic lock plate. To unlock the lock, a magnetic key is slid between the magnetic plate and a non magnetic plate and repels the pins so that they are pushed out of the apertures in the lock plate. The slide member is then free to slide relative to the lock plate. The key engages a flange on the slide member so that further movement of the key moves the slide member to allow operation of the lock.

The code of the lock is governed by the number, position and polarity of magnet pins relative to the lock plate. In PCT/GB90/00246 the lock code can be changed by providing rotatable wheels or carriers for some of the magnet pins which are coupled to rotate together and caused to rotate by the action of inserting a code changing key. The code changing key moves appropriate of the magnets in the carriers to enable the carriers to rotate through a predetermined angle as the key is inserted to unlock the lock so that the relative location of the magnets in the plane of the slider is changed. This action normally involves a selected magnet or magnets in the carriers being acted upon by the code changing key, so that movement of the slider causes the carriers to rotate to a new angular position for the next code in a sequence of codes.

According to the present invention there is provided a magnetic key operated lock comprising a slide member movable from a locked position to an unlocking position with a key having a magnetic code encoded in it, a plurality of magnet pins slidable transversely of the slide member from a first position locking the slide member in said locked position to a second position unlocking said slide member on operation of the lock by a said key, the position and polarity of some or all of the magnet pins forming a code for the lock, one or more of said magnet pins being mounted in at least one rotatable carrier in said lock for moving said pins from a first location to a second location to change the code of the lock from a first code to a second code, the carrier being rotated through a predetermined angle when a code changing key having a code changing code encoded in it is inserted into said lock in which securing means are provided for preventing rotation of the carrier arranged to be released by said key whenever it is substantially fully inserted in the lock.

The securing means may comprise a spring biassed bar slidably mounted in the lock to press at one end against the carrier, the bar being shaped to be urged by the code changing key when it is substantially fully inserted to disengage the one end from the carrier.

The lock may comprise a carrier with peripheral gear teeth and the bar may be slidable in a plane off-set from the rotational axis of the carrier such that the one end of the bar moves towards the periphery it always tends to abut between a respective pair of teeth, causing if necessary a small rotation of the carrier.

The carrier may be positioned adjacent the entry of the lock and the securing means released by engaging a forward end of the code changing key when it is substantially fully inserted.

The securing means may comprise alternatively or additionally a magnet pin in the carrier and a respective aperture in the slide member aligned with the pin into which the pin can be located for preventing rotation of the carrier, which pin is disengaged from the aperture by said key whenever it is substantially fully inserted in the lock.

Rotation of the carrier may be always inhibited to some extent to prevent spurious rotation thereof. The carrier may for example be frictionally mounted on a stationary central shaft such as to inhibit rotation of the carrier to some extent.

A magnetic key operated lock will now be described by way of example with reference to the accompanying drawings in which.

FIGS. 9*a* to 9*e* show plan views of some different keys for the lock.

Figure 1:
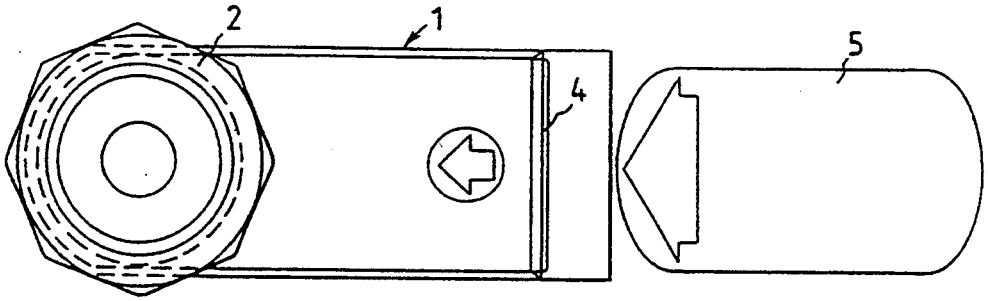
FIG. 1 is a plan view of the lock and a key.
Figure 2:
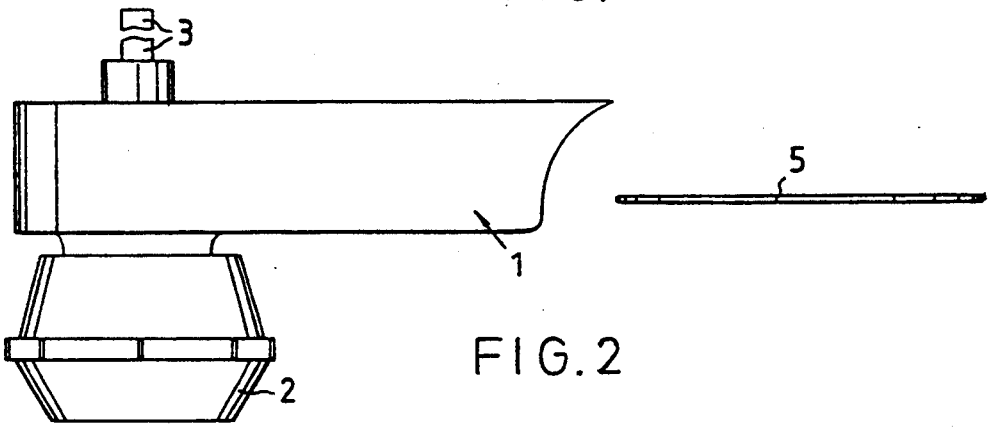
FIG. 2 is a side view of the lock and the key.

Referring to FIGS. 1 and 2 the lock comprises an elongate lock case 1 which supports a rotatable knob 2. The knob is arranged to be coupled to a spindle 3 when the lock is in the unlocking position so that rotation of the knob 2 will turn the spindle to retract a latch or bolt (not shown). When the lock is in the locked position the knob 2 is freely rotatable on the case 1 so that the lock cannot be forced. To unlock the lock a magnetic key 5 is inserted in a slot 4 in the case 1. This operation will be described in more detail hereinafter. The key 5 comprises magnetic material sandwiched between plastic or metal plates, magnetised with a plurality of discrete north and south poles which form a code matching the code of the lock.

Figure 3:
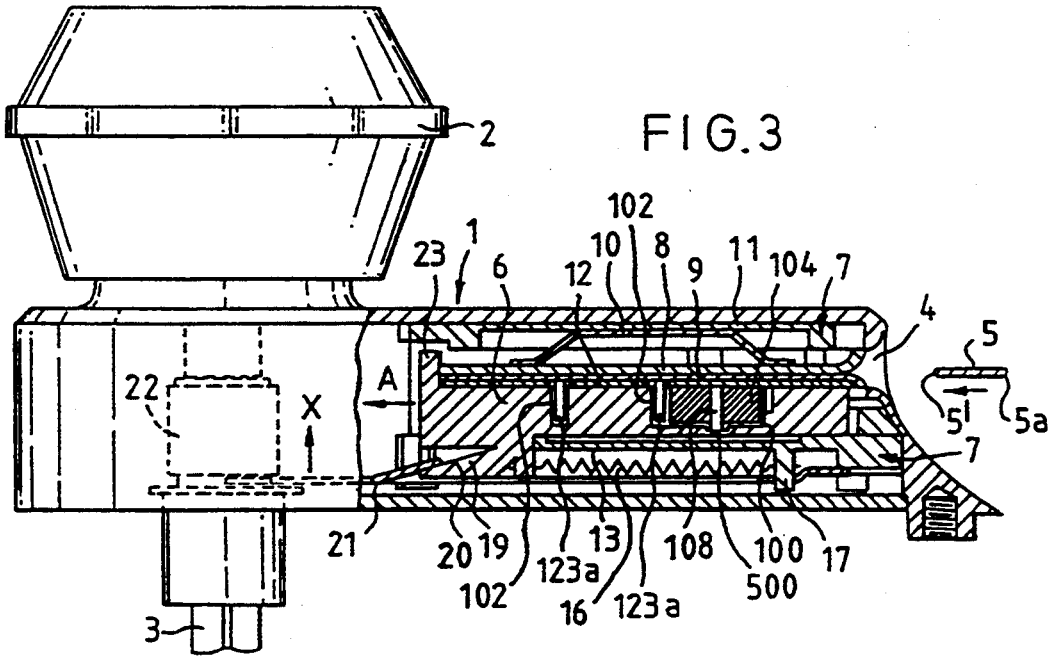
FIG. 3 is a cross-sectional side view of the lock and key.

Referring to FIG. 3, the case 1 houses an inner case 7 which carries the lock mechanism. The inner case 7 is fixed in position in the case 1. A slide member 6 is mounted in the inner case 7 and is slidable by the key 5 in the direction of arrow A. The slide member 6 has a plurality of blind bores 102 which are distributed across the plane of the slide member. Tumblers of the lock are formed by magnet pins 123*a* (small cylindrical permanent magnets) which are accommodated in some or all of the bores 102. Overlaying the open ends of the bores is a fixed lock plate 12 which is fixed in position in the inner case 7 and has apertures 13 which, in the locked position of the slide 6, are aligned with the open ends of the bores 102. A first guide plate 9 of non-magnetic material, such as brass, overlays the fixed plate 12 and, also, is fixed in position with the plate 12. A second, thicker, guide plate 8 bears on the first guide plate 9 and is biassed against the first plate by a leaf spring 10 supported on a wall 11 of the inner case 7. The second guide plate is of magnetizable material such as ferromagnetic steel.

In the locking position, seen in FIG. 3, the magnet pins 123*a* are attracted to the second guide plate 8 so that the ends of the pins project into the apertures 13 and abut the first guide plate 9. Hence the slide 6 cannot be slid relative to the lock plate 12. To unlock the lock, a key 5 is slid between the first and second guide plates, 9, 8, the guide plate 8 moving back against the force of the spring 10. The key 5 has a plurality of magnetic poles imprinted on its operating side 5*a*, these poles are positioned so that when the key is fully inserted, its tip 5' abuts a toe 23 on the slide member 6, the poles are arranged opposite the magnet pins 102*a* and are of the same polarity as the adjacent ends of the pins 102*a*. Hence the pins are pushed out of the apertures 13 by magnetic repulsion and sit on the bottom of the blind bores 102. The slide member 6 is thus unlocked and can be slid by pushing further on the key 5 in the direction of arrow A. A wedge shaped heel 19 on the slide member 6 has a cam surface 20 which depresses a fork 21 which in turn moves a coupling sleeve 22 in the direction of arrow X to connect the knob 2 with the spindle 3 so that the bolt or latch etc. can be opened by rotating the spindle 3.

As the key 5 is inserted it rides over two cams (not shown) which along with a spring member (not shown) cause the slide member to stay in place when it reaches the unlocking position. This allows the user to release the key and turn the knob 2, and hence open the lock with one hand. When the key 5 is removed, the slide member stays in the unlocking position until the key 5 is withdrawn past the cams.

As the key 5 is so withdrawn, the slide member 6 is pulled back to its locked position by a coil spring 16 attached between the heel 19 and a stop 17 on the inner casing 7 (the spring having been tensioned during the forward stroke of the slide member), the magnet pins entering their respective apertures 13 when the slide member returns to its locked position.

Figure 4:
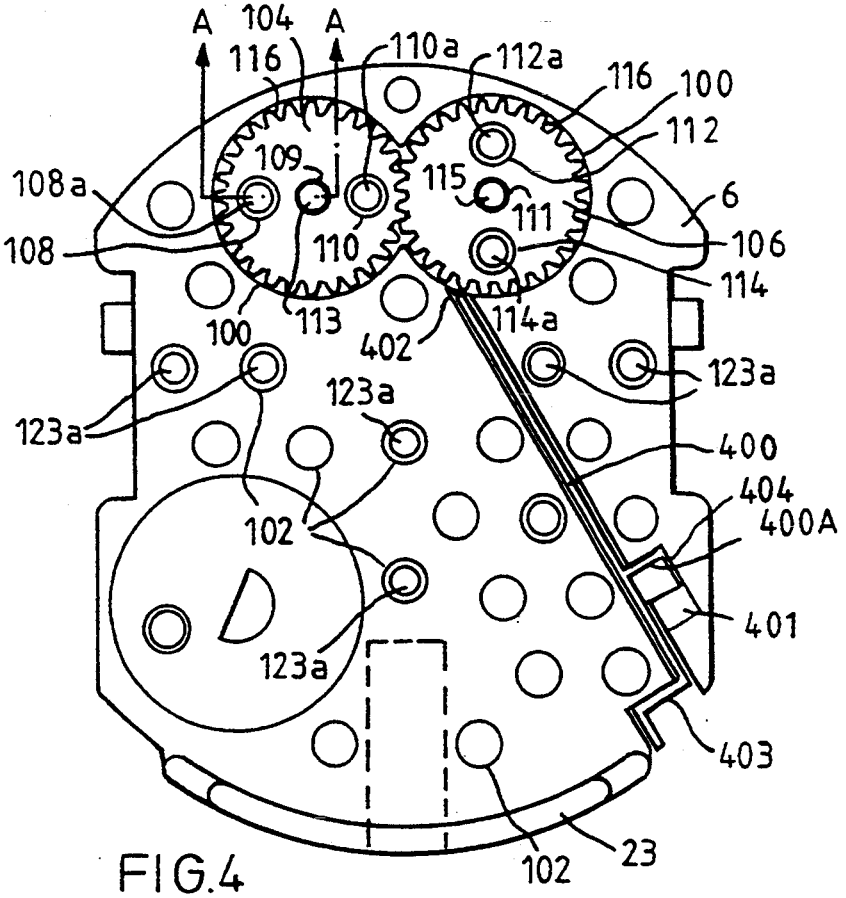
FIG. 4 is a detail plan view showing a slide member of the lock with securing means in an operative position.
Figure 5:
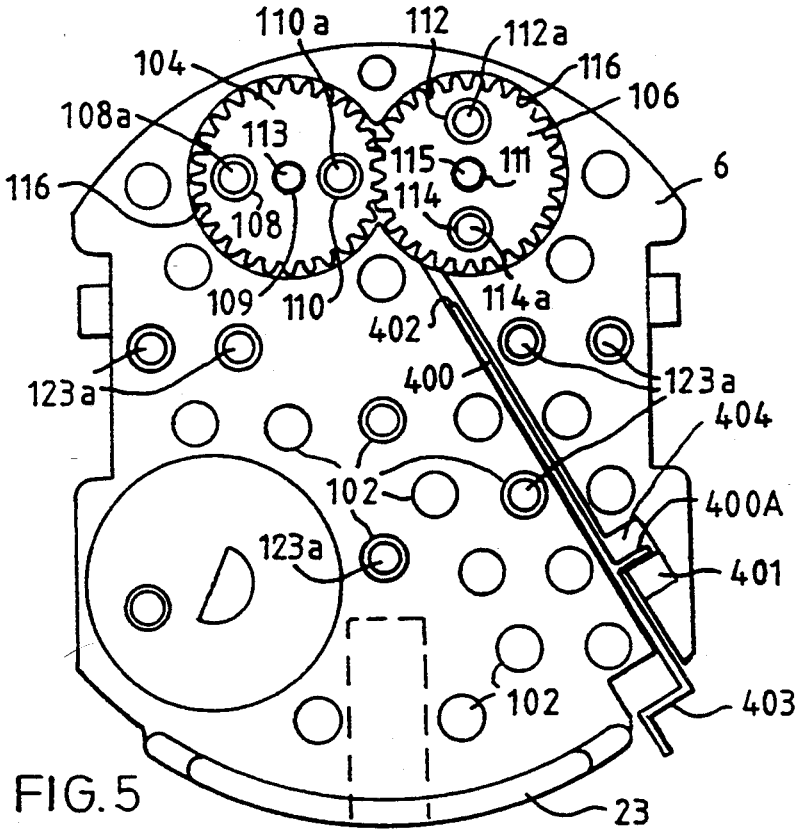
FIG. 5 is a view of FIG. 4 with securing means in a released position.

Also seen in FIGS. 3, 4 and 5 is a movable magnet pin 108*a*. The magnet pin 108*a* is received in a through bore 108 in a carrier in the form of a wheel 104 which is rotatably mounted on a shaft 113 in a bore 100 in the slide member 6. Two such carriers 104 and 106 (see FIG. 4) in this case of equal size, each carrying respective magnet pins 108*a*, 110*a* and 112*a*, 114*a* are provided in respective bores 100 in the slide member 6. The wheels have peripheral gear teeth and intermesh so that rotation of one carrier causes the other carrier to rotate.

Pins 108*a*, 110*a*, 112*a*, and 114*a* are pins in carriers, one of which is a code changing pin in each of four code changes. Of the other three, one is a locking pin and, two are in a slot in the lock plate 12. To change the code, the pin in the code-changing position must be attracted, the other three repelled. After the code is changed a key with an operating code is used subsequently to unlock the lock, the code change pin and the lock pin are repelled, the other two in the vertical slot can be attracted.

Figure 7:
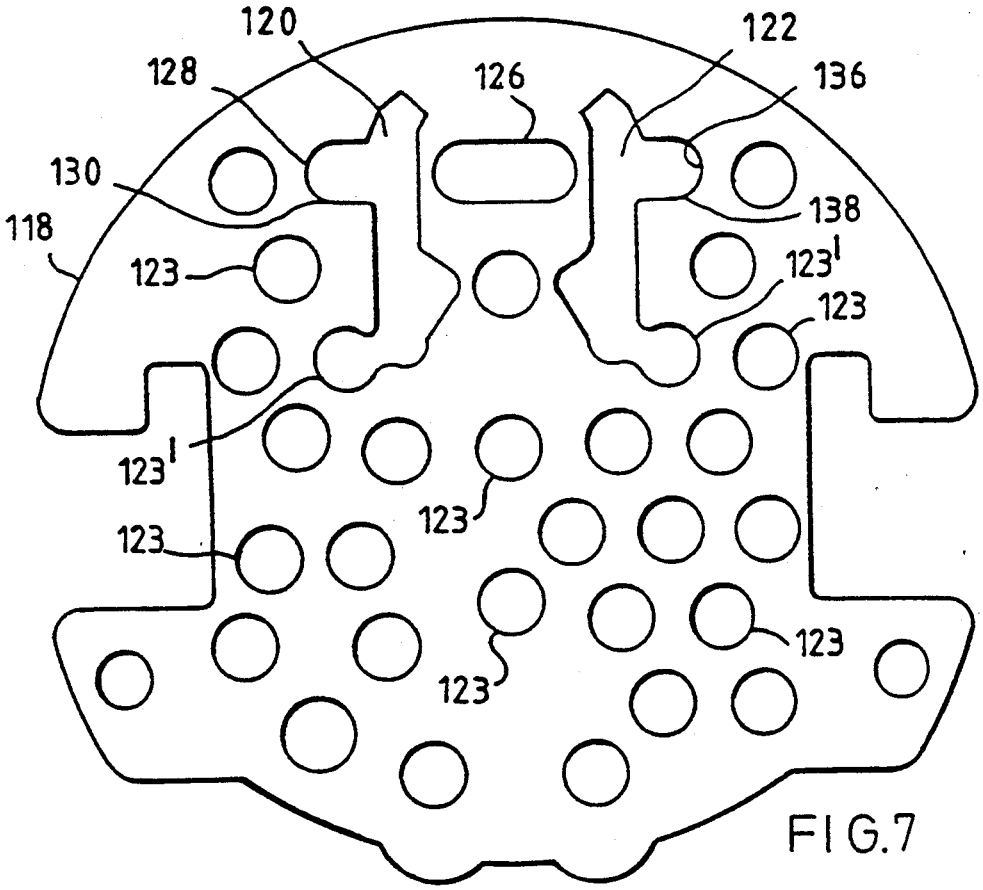
FIG. 7 is a plan view of a fixed lock plate for the lock.

If a code changing key is inserted, the pins are likewise caused to move out of the apertures 13 with the exception, in this case, of the pin 108*a* which is attracted by the code changing key into an ear 128 in the fixed plate 12 (see FIG. 7). In use, interengagement between the pins and the sides 130 and 138 of the ears 128 and 136 causes rotation of the carriers 104 and 106 for changing the codes. This is fully described in PCT/GB90/00246 as with reference to FIGS. 15 to 19. Lock code changes are carried out using different code changing keys as required, see PCT/GB90/00246.

The "fixed" operating code for the lock therefore depends on the disposition and polarity of any magnet pins in the apertures 102. The changable code depends on the relative rotational position of the carriers 104 and 106 and the position of the magnet pins in apertures 108, 110, 112 and 114.

In the arrangements described in PCT/GB90/00246 it could happen in some cases, as the carriers might be generally free to rotate when using a coded key, that spurious rotation could take place as the key is inserted or when a key is inserted the wrong way round (reversed or inverted), or if the lock is vibrated accidentally or perhaps deliberately tampered with. This may happen because magnetic areas of the key tend to cause rotation of the carriers by attraction or repulsion of the pins or due to the influence on the carrier pins of "fixed" magnet pins adjacent to the carriers in the slide member 6. In fact, to reduce the influence of such adjacent fixed magnets, in the prior art, certain codes or pin dispositions were sometimes of necessity avoided. In any event, spurious rotation of the carriers could render the lock inoperable or cause an inadvertent code change.

In FIGS. 4 and 5, the slide member 6 includes a carrier securing mechanism to prevent the spurious rotation. The mechanism comprises (shown in more detail in FIG. 8) a bar 400 slidably mounted in the member 6 and biassed by a spring 401, which bears against an intermediate lateral finger 400A which partially covers the spring 401, so that one end 402 of the bar 400 engages the peripheral gear teeth of the carrier 106. The spring is housed or retained in a cavity 404 provided in the member 6. The other end 403 of the bar is cranked such that, when a suitable key 5 is almost fully inserted, the front edge 5' of the key pushes against the end 403 and the opposite end 402 is disengaged from the periphery of the carrier 106. The bar 400 thus prevents rotation of the carrier 106 until the key is substantially fully inserted into the lock. As soon as the key begins to be removed, the bar 400 automatically springs back and prevents rotation of the carrier 106. Rotation of the carriers 104 and 106 can therefore only take place when a key (with correct coding) is fully inserted and spurious carrier rotation at other times is prevented.

Figure 8:
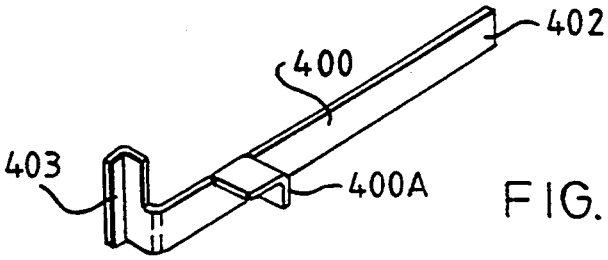
FIG. 8 is an isometric view of a securing bar for the lock.

The bar 400, see FIG. 8, is integrally formed by stamping out of non-magnetic metal plate and bending to form the shape as shown.

It will be noted that the bar 400 is mounted to slide in a plane which is off-set from the axis of rotation of the carrier 106. This means that when the bar 400 returns under the action of the spring 401 to contact the periphery of the carrier, to secure the carrier 106 against rotation, the end 402 tends to rest against the side of one tooth and extend between a pair of teeth. In practice, the bar 400 will rotate the carrier 106 at least slightly if necessary so that the end 402 bears against the side of the tooth. More importantly, because the sliding plane of the bar 400 is angled or off-set, there is little likelihood of the end 402 coming to rest against an apex of a single tooth and securing the carrier 106 in such a comparatively unstable position.

A code changing key for this described lock has a continuous arcuate forward end (see FIG. 1) so that when it presses against the toe 23, it releases the securing means as described. In such an arrangement, single code operating keys or other keys (which are not code changing keys) including master keys are formed with a small cut-out such that when they are fully inserted such keys do not press against the cranked end 403 and the carrier is not released. It will be appreciated that, alternatively, the code changing keys may be formed with a suitably formed small lip or the like which is designed to engage the end of the bar 400 and the normal operating keys are then formed without such lips. In this context the bar 400 may be formed somewhat differently and arranged to engage a lip or special protrusion on a code changing key provided intermediate its length or elsewhere but in a manner such that the carrier is only released when the operating key is substantially fully inserted. In such an arrangement, a code changing key could also be designed to cause the bar 400 to move by direct or indirect magnetically responsive mechanical inter-connection between the key and the bar 400. The code changing key could for example be thicker or wider than other keys in a way to engage the bar 400 whereas other keys do not.

The carriers 104 and 106 are normally arranged to be freely rotatable. In order to reduce further the possibility of spurious rotation one or both carriers 104 and 106 may be mounted so that their rotation is always inhibited to some extent. This can be achieved by providing a friction fitting between each carrier and its central shaft. Also a resilient finger may be provided which bears on one respective side face or rim of a carrier but positioned to engage the carrier at a radius or location which does not include any of the apertures in the carrier.

Figure 6:
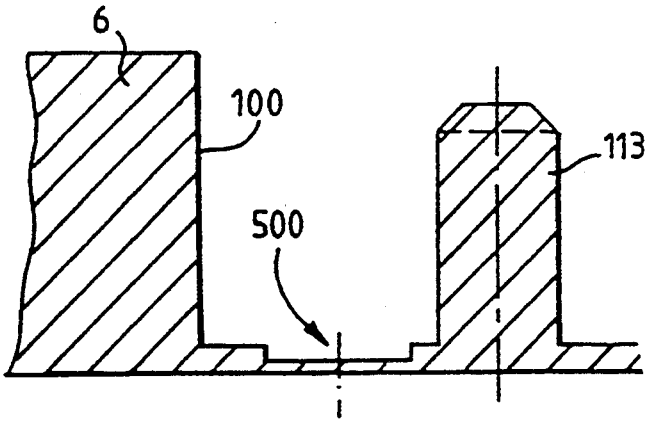
FIG. 6 is a sectional view taken on A—A of FIG. 4.

In an additional or alternative arrangement, the braking mechanism consists of a separate magnet pin, or one of the magnet pins 108*a*, 110*a*, 112*a* or 114*a*, which is movable into appropriate suitable apertures, or blind bores 500, in the member 6 (see especially FIG. 6 which shows an enlarged section of the member 6 with the carrier 104 removed). This secures or locks the carrier against rotation. A similar blind bore is behind carrier 106. Also a code changing key is arranged with a magnet area suitably positioned so that when the key is fully inserted it attracts an appropriate magnet pin to ensure the pin is not in its blind bore 500 so that the carriers can rotate. When a key coded as an operating key (not a code changing key) is inserted in the lock, the separate pin or an appropriate one of the pins shown in the carriers 104 or 106, cooperates with a respective blind bore 500 to secure or brake the carriers against rotational movement during operation of the lock.

Even where the bar 400 is provided, once its end 402 is disengaged from the periphery of the carrier 106, the carriers 104 and 106 could be free to rotate if all the carrier pins were repelled. Thus in this condition, vibration of the lock or key magnetic attraction or repulsion of the carrier pins by adjacent fixed magnets or from magnetic areas on the inserted key could cause unwanted rotation of the carriers. This is inhibited by providing the blind bores 500 as described, aligned with and directly behind the location of code changing carrier pins such as 108*a* in FIG. 4. The blind bores 500 are located in the region of the slide member 6 that also supports the center posts 113 and 115 (see FIGS. 4, 5 and 6).

For example: A key with a correct operating code repels the pin 108*a* so that it cannot cause a change of the code of the lock. This pin enters an appropriate bore 500 and prevents rotation of the carrier 104. A blind bore is provided behind the location of the code changing pin in each carrier.

A key with an operating code repels the pin 108*a* so it cannot cause a change of the code of the lock. Thus, one of the carrier enters an appropriate bore 500 and prevents rotation of the carrier 104. A blind bore is provided behind the location of each code changing pin in each carrier.

At any one time, of the four pins in the two carriers 104 and 106 only one is actually a locking pin; the inside one of the two horizontal pins. This pin enters the horizontal elongated hole 126 in the lockplate 12 and acts like a locking pin. However if all three of the other pins are repelled and only this one remains in lock, pushing down of the slide member 6 will cause the carriers to rotate in reverse direction around the locked pin. The carrier cannot rotate very far as the pin hits the end of the elongated lock plate hole 126, but this movement is sometimes enough to jam the lock when a subsequent key is inserted.

This polarity combination can occur on a reversed plastic key or on a code-changing key and, prior to the use of the blind bores 500, prevented the use of "Recycle" keys described which change the code each time the key is inserted, key #1 from code 1 to code 2 on first insertion, then Code 2 to code 3 on second insertion, where it will lock at that point on the third insertion. Then key #2 changes 3 to 4, then 4 to 1 and will stop at 1. If this type of key is inserted while the lock is at another setting, such as key #2 inserted at code 2, it previously caused jamming of the lock between codes. The blind bores 500 prevent this spurious rotation as well because when the code-changing pin is repelled it enters the blind bore and then both horizontal pins are locked, one by the hole 126 and the other by a blind bore 500, and so the carriers cannot rotate.

Whereas embodiments of the invention can comprise using either the bar 400 (or similar) to prevent rotation of the carriers, or pins and blind bores to secure or lock the carriers except when a code changing key is used, the preferred embodiment of the invention consists of two interrelated securing mechanisms as described. A bar 400 to secure the carriers against rotation while the lock is locked and no key is inserted or while a key is being inserted or withdrawn, and magnet pins which enter blind bores 500 in the slide member 6 to secure the carriers during movement of the slide member 6 by an inserted operating key with an operating code during which time rotation of the carriers is no longer prevented by the bar 400.

Figure 9A:
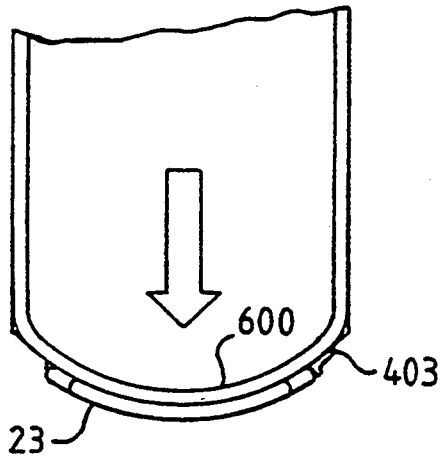
Figure 9B:
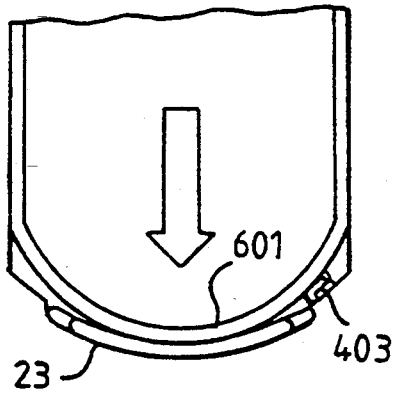

In FIGS. 9*a* to 9*e*, examples of keys are shown for the described lock. FIG. 9*a* shows a metal code changing key which can only operate when inserted allow face forward. The forward arcuate end of the key has the same radius as the toe 23 of the slide member 6 (in FIG. 1) and when fully inserted as shown bears against the toe 23 and the end 403 of the bar 400, see FIGS. 4 and 5. FIG. 9*b* shows a master key which is a metal key. Its arcuate forward edge 601 has a smaller radius than the toe 23 so that when fully inserted the key in FIG. 9*b* does not press against the end 403 and release the other end of the bar 400 from the carrier 106. The key of FIG. 9*b* does not change the lock code or release the carrier securing means.

Figure 9C:
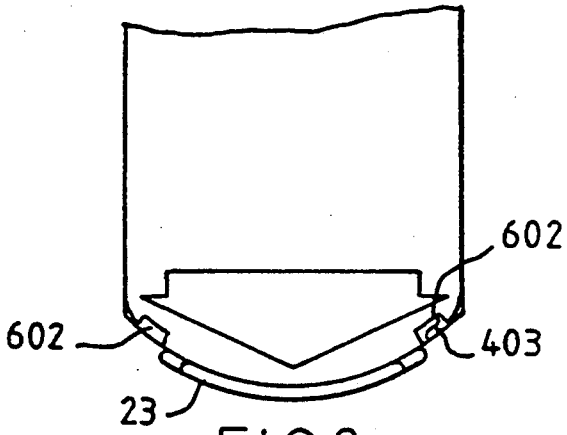

The key of FIG. 9c is a plastic master key and has cut-outs 602 at both sides of its forward arcuate edge. This key cannot release the bar 400 from its engagement with the carrier 106 even if it is inserted in the slot of the lock an incorrect alignment.

Figure 9D:
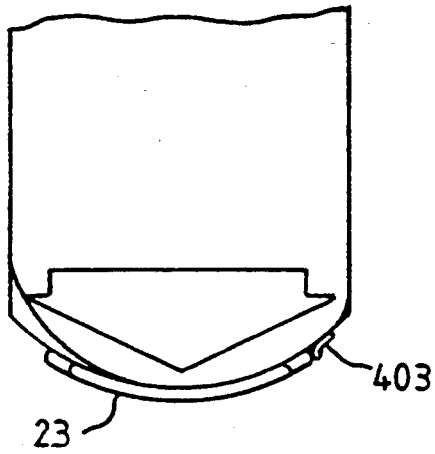
Figure 9E:
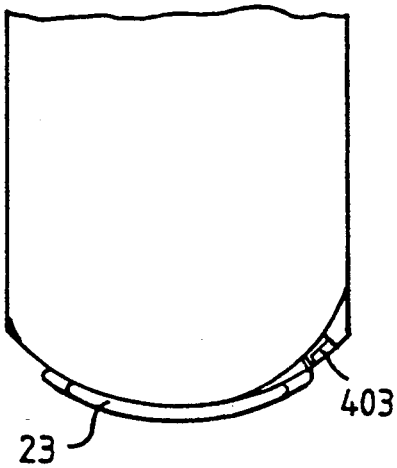

FIGS. 9d and 9e show the two sides of a plastic code changing key. Its forward arcuate edge is formed with different radii at each side. When inserted correctly, see FIG. 9d the forward edge bears against the end 403 of the bar 400 to release the carrier 106 and allow the carrier 106 to rotate as required for changing the lock code. If the key is inserted incorrectly, that is the key is rotated one-half a turn about an axis in FIG. 9d and/or FIG. 9e that extends from the bottom of the view(s) to the top, the forward edge does not engage the end 403 when the key is pressed against the toe 43. The carrier 106 therefore remains secure against rotation by engagement with the bar 400 and the lock code cannot change. Nor can vibrations of the lock or key cause any spurious rotation of the carriers 104 or 106.

I claim:

1. A magnetic key operated lock, comprising:

a slide member movable from a locked position to an unlocking position with a key having a magnetic code encoded in the key;

a plurality of magnet pins slidable transversely of the slide member from a first position locking the slide member in said locked position to a second position unlocking said slide member on operation of the lock by said key, a position and a polarity of at least some of the magnet pins forming a code for the lock;

at least one of said magnet pins being mounted in at least one rotatable carrier in said lock for moving said pins from a first code to a second code, the carrier being rotated through a predetermined angle when a key having a code changing code encoded in said key is inserted into said lock, in which securing means are provided for the carrier to prevent rotation of the carrier and arranged to be released by said key whenever said key is substantially fully inserted in the lock; and, wherein, the securing means comprises a spring biassed bar slidably mounted in the lock to press at one end against the carrier, the bar being shaped to be urged by said key when it is substantially fully inserted to disengage the one end from the carrier.

2. A lock according to claim 1, in which the carrier has peripheral gear teeth and the bar is slidable in a plane off-set from a rotational axis of the carrier such that as the one end of the bar moves towards a periphery, the one end always tends to abut between a respective pair of teeth, causing if necessary a small rotation of the carrier.

3. A lock according to claim 1, in which the lock defines a slot entry, the carrier is positioned adjacent the slot entry of the lock, and the securing means is released by engaging a forward end of said key when the key is substantially fully inserted.

4. A lock according to claim 1, wherein rotation of the carrier is always frictionally inhibited to some extent to prevent spurious rotation thereof.

5. A lock according to claim 4, characterised in that the carrier is frictionally mounted on a stationary central shaft such as to inhibit rotation of the carrier to some extent.

6. A magnetic key operated lock, comprising:

a slide member movable from a locked position to an unlocking position with a key having a magnetic code encoded in the key;

a plurality of magnet pins slidable transversely of the slide member from a first position locking the slide member in said locked position to a second position unlocking said slide member on operation of the lock by said key, a position and a polarity of at least some of the magnet pins forming a code for the lock;

at least one of said magnet pins being mounted in at least one rotatable carrier in said lock for moving said pins from a first code to a second code, the carrier being rotated through a predetermined angle when a key having a code changing code encoded in said key is inserted into said lock, in which securing means are provided for the carrier to prevent rotation of the carrier and arranged to be released by said key whenever said key is substantially fully inserted in the lock; and, wherein, the securing means comprises a magnet pin in the carrier and a respective aperture in the slide member aligned with the pin, into which the pin can be located for preventing rotation of the carrier, which pin is disengaged from the aperture by said code-changing key whenever the code-changing key is substantially fully inserted in the lock, and is exclusively limited to being disengaged from the aperture on operation of the lock by said code-changing key.

7. A key for a lock according to claim 6 including a magnet area arranged to repel a magnet pin into a blind aperture in the slide member when the key is fully inserted in the lock.

8. A magnetic key operated lock, comprising:

a slide member movable from a locked position to an unlocking position with a key having a magnetic code encoded in the key;

a plurality of magnet pins slidable transversely of the slide member from a first position locking the slide member in said locked position to a second position unlocking said slide member on operation of the lock by said key, a position and a polarity of at least some of the magnet pins forming a code for the lock;

at least one of said magnet pins being mounted in at least one rotatable carrier in said lock for moving said pins from a first code to a second code, the carrier being rotated through a predetermined angle when a key having a code changing code encoded in said key is inserted into said lock, in which securing means are provided for the carrier to prevent rotation of the carrier and arranged to be released by said key whenever said key is substantially fully inserted in the lock; and, a key having a forward edge with at least one cut-out portion arranged so that when the key is fully inserted in the lock the securing means is not released by the key.

9. A magnetic key operated lock, comprising:

a slide member movable from a locked position to an unlocking position with a key having a magnetic code encoded in the key;

a plurality of magnet pins slidable transversely of the slide member from a first position locking the slide member in said locked position to a second position unlocking said slide member on operation of the lock by said key, a position and a polarity of at least some of the magnet pins forming a code for the lock:

at least one of said magnet pins being mounted in at least one rotatable carrier in said lock for moving said pins from a first code to a second code, the carrier being rotated through a predetermined angle when a key having a code changing code encoded in said key is inserted into said lock, in which securing means are provided for the carrier to prevent rotation of the carrier and arranged to be released by said key whenever said key is substantially fully inserted in the lock; and, a key having a non-uniform forward end arranged so that the key releases the securing means only when inserted in one correct alignment.

10. A key for a magnetic key operated lock with a slide member movable from a locked position to an unlocking position with a key having a magnetic code encoded in the key, a plurality of magnet pins slidable transversely of the slide member from a first position locking the slide member in said locked position to a second position unlocking said slide member on operation of the lock by said key, a position and a polarity of at least some of the magnet pins forming a code for the lock, at least one of said magnet pins being mounted in at least one rotatable carrier in said lock for moving said pins from a first code to a second code, the carrier being rotated through a predetermined angle when a key having a code changing code encoded in said key is inserted into said lock, in which securing means are provided for the carrier to prevent rotation of the carrier and arranged to be released by said key whenever said key is substantially fully inserted in the lock, and, wherein, the securing means comprises a spring biassed bar slidably mounted in the lock to press at one end against the carrier, the bar being shaped to be urged by said key when it is substantially fully inserted to disengage the one end from the carrier, the key comprising:

a body carrying predetermined magnetic codes arranged with one code for unlocking the lock, one code for changing the lock code from one lock code to another lock code, and one code for continuing to unlock the lock after the lock code has been changed to the other lock code.

* * * * *

UNITED STATES PATENT AND TRADEMARK OFFICE

CERTIFICATE OF CORRECTION

PATENT NO. : 5,406,815

DATED : April 18, 1995

INVENTOR(S) : Bruce S. Sedley and Mei Foo Sun Cheun

It is certified that error appears in the above-indentified patent and that said Letters Patent is hereby corrected as shown below:

Column 1, line 9 "002422" should be --0024242--.

Column 7,
Claim 5, line 1, delete "characterised in that" and substitute therefor --in which--.

Signed and Sealed this

Twenty-second Day of August, 1995

Bruce Lehman

*Attest:*

BRUCE LEHMAN

*Attesting Officer*

*Commissioner of Patents and Trademarks*